United States Patent [19]

Giolitti

[11] Patent Number: 4,469,458

[45] Date of Patent: Sep. 4, 1984

[54] POSITION CONTROL MECHANISM FOR A TYPEWRITER RIBBON CARTRIDGE

[75] Inventor: Nicolò Giolitti, Ivrea, Italy

[73] Assignee: Remington Ind. E Com. De Sistemas Para Escritorio S.A., Rio de Janeiro, Brazil

[21] Appl. No.: 366,567

[22] Filed: Apr. 8, 1982

[30] Foreign Application Priority Data

Apr. 28, 1981 [IT] Italy ..... 67573 A/81

[51] Int. Cl.[3] ..... B41J 35/22

[52] U.S. Cl. ..... 400/214; 400/208; 400/697.1

[58] Field of Search ..... 400/194, 195, 196, 196.1, 400/207, 208, 208.1, 214, 696, 697, 697.1

[56] References Cited

U.S. PATENT DOCUMENTS

| | | | |
|---|---|---|---|
| 3,995,731 | 12/1976 | Miller et al. | 400/196 X |
| 4,247,210 | 1/1981 | Kacmarcik et al. | 400/697.1 X |
| 4,347,007 | 8/1982 | Schaefer | 400/697.1 X |

FOREIGN PATENT DOCUMENTS

| | | | |
|---|---|---|---|
| 2901611 | 7/1980 | Fed. Rep. of Germany | 400/208 |
| 2306836 | 11/1976 | France | 400/208 |
| 69189 | 6/1981 | Japan | 400/697.1 |
| 120383 | 9/1981 | Japan | 400/697.1 |

OTHER PUBLICATIONS

IBM Technical Disclosure Bulletin, "Multicolor Matrix Impact Printer," Meier, vol. 21, No. 11, Apr. 1979, pp. 4448–4451.

*Primary Examiner*—Ernest T. Wright, Jr.
*Attorney, Agent, or Firm*—Michael N. Meller

[57] ABSTRACT

A typewriter with a ribbon cartridge of the type having a frame which supports first and second ribbons on different planes, and having a mechanism which controls the positioning of the cartridge with respect to a typing member and which includes at least one drive shaft carrying cams for rotation therewith; an element for supporting the frame of the cartridge; rocker levers controlled by the cams and operable to control the displacement of the frame via the support element; and two positioning elements each of which is operable to maintain a respective lever in two distinct working positions.

14 Claims, 10 Drawing Figures

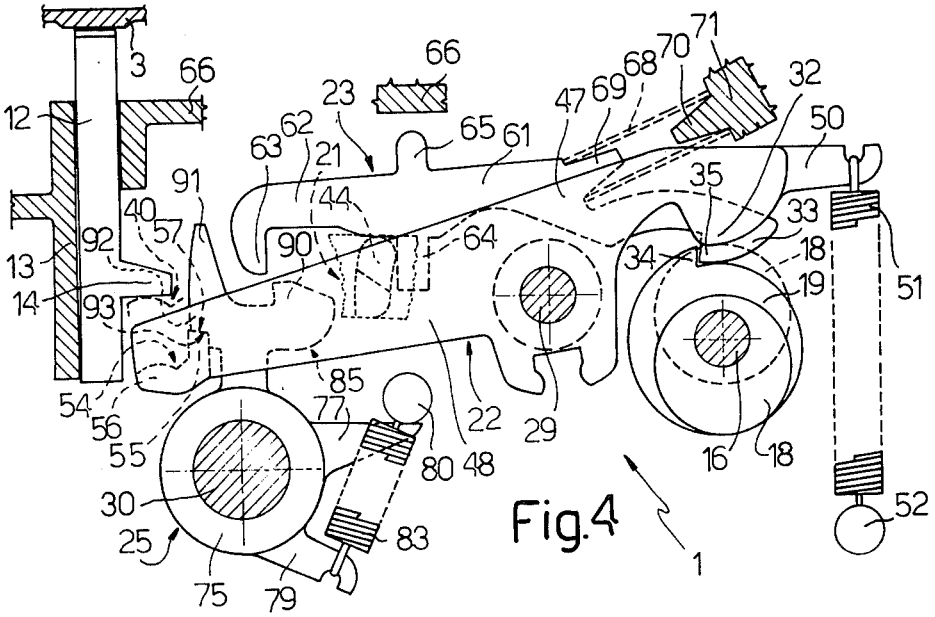
Fig.4
Fig.5
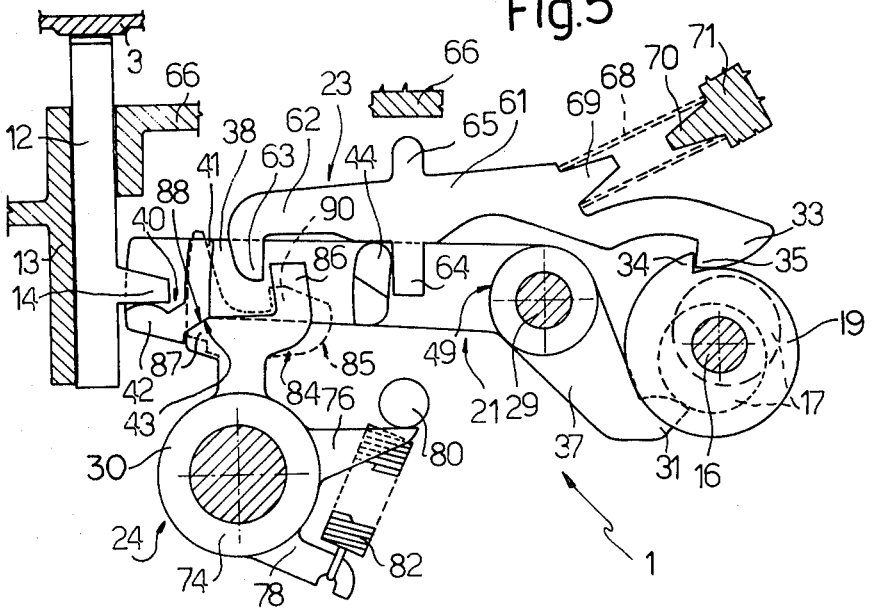

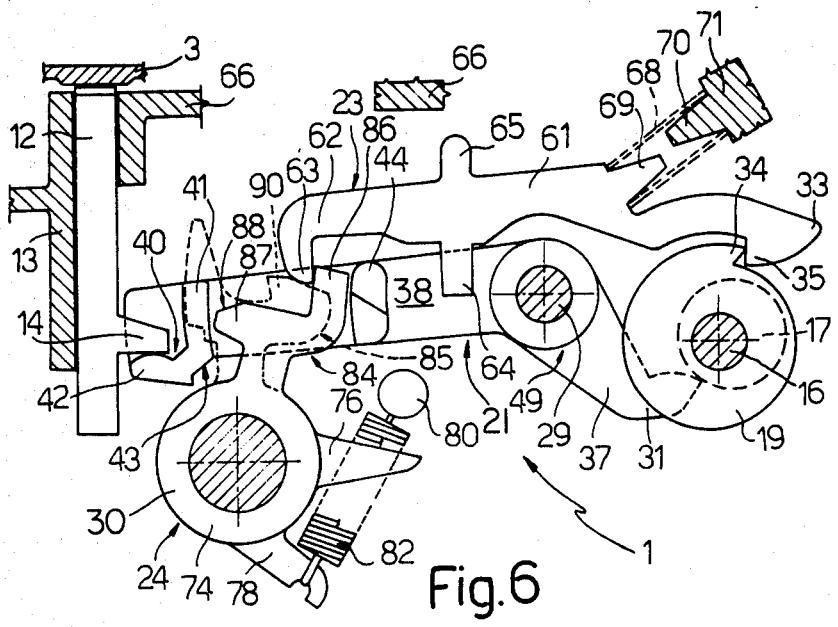
Fig.6
Fig.7
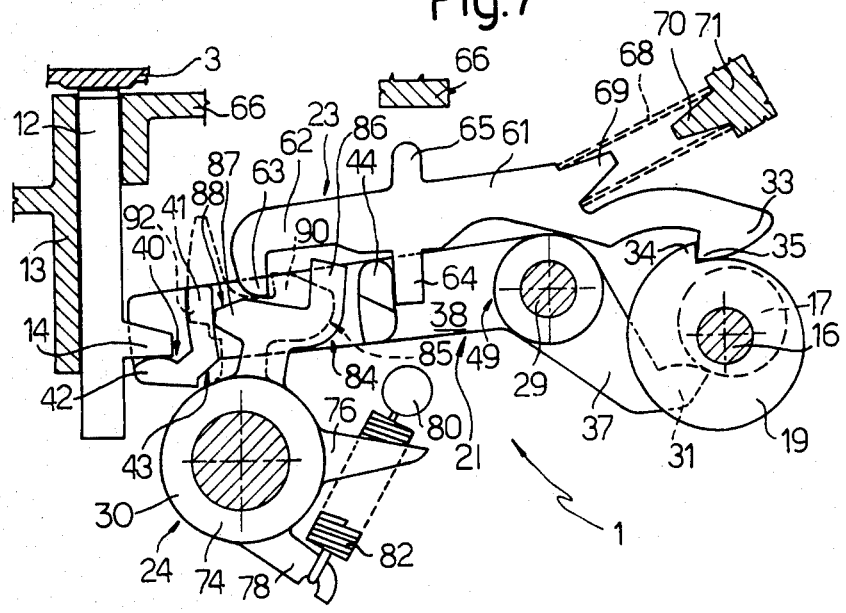

POSITION CONTROL MECHANISM FOR A TYPEWRITER RIBBON CARTRIDGE

BACKGROUND OF THE INVENTION

The present invention relates to a typewriter and in particular to a mechanism for controlling the position of a ribbon cartridge of the typewriter. In more detail, the mechanism formed according to the present invention is able to control the positioning of a typewriter ribbon cartridge of the type having a frame which supports, on different planes, first and second ribbons such as, for example, a typewriter ribbon and a correction ribbon. Such a mechanism must be able to position the cartridge in at least three different positions: in the first position the first ribbon must be located in front of a typing member such as, for example, the end of a "petal" of a "daisy wheel" on which the character to by typed is formed; in the second position the second ribbon must be located in front of the end of the petal; and in the third position the cartridge must be displaced downwardly in such a way that neither the first nor the second ribbon is positioned in front of the said typewriter member.

Displacements of the above-mentioned cartridge can take place in different ways.

SUMMARY OF THE INVENTION

The object of the present invention is that of providing a position control mechanism for a cartridge of the above-mentioned type which will be able to perform at least the three positioning operations described above, which requires a simple operational control and which can be formed with a minimum weight given that this mechanism, in use, must follow the displacements of the cartridge and must therefore be moved with the latter.

This object is achieved with the present invention which has a typewriter ribbon cartridge of the type having a frame which supports, on different planes, a first and a second ribbon, and a mechanism which controls the positioning of the cartridge with respect to a typewriting member, this mechanism being characterized by the fact that it comprises:

(a) a drive shaft, the turning of which about its own axis is governed by control means which establish, on the basis of signals received from the keyboard of the typewriter, both the direction (clockwise or anti-clockwise) and the magnitude thereof;

(b) a support element which supports the frame of the cartridge;

(c) conversion means which convert the rotation of the drive shaft into axial displacements of the support element in such a way as to make the cartridge assume either a first, a second or a third stable position, in the first of which positions the first ribbon is located in front of the typewriting member, in the second of which positions the second ribbon is located in front of the typewriting member, and in the third of which positions neither of the ribbons is located in front of the typewriting member.

BRIEF DESCRIPTION OF THE DRAWING

For a better understanding of the present invention a preferred embodiment will now be described, by way of non-limitative example, with reference to the attached drawing, in which:

FIGS. 4 to 10 illustrate, on a reduced scale, the mechanism of FIG. 1 in its main operating positions.

DETAILED DESCRIPTION OF THE INVENTION

Figure 1:
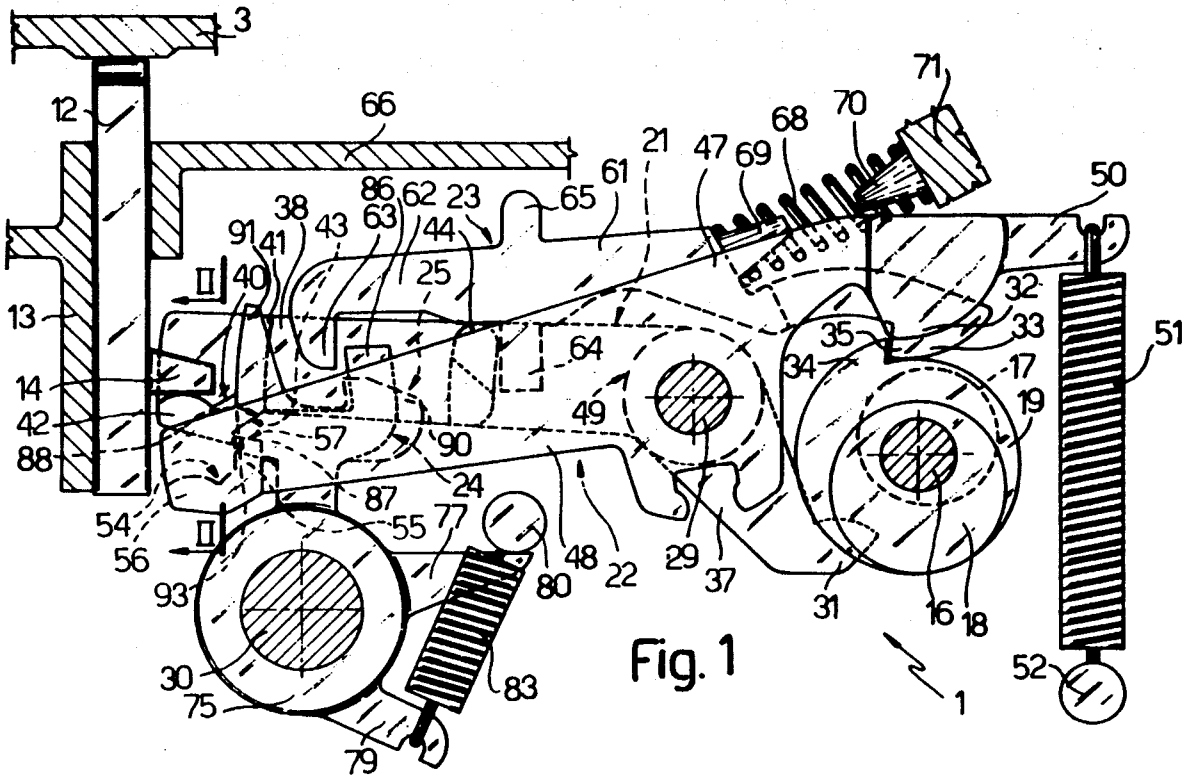
FIG. 1 is a side view of a mechanism formed according to the principles of the present invention.
Figure 2:
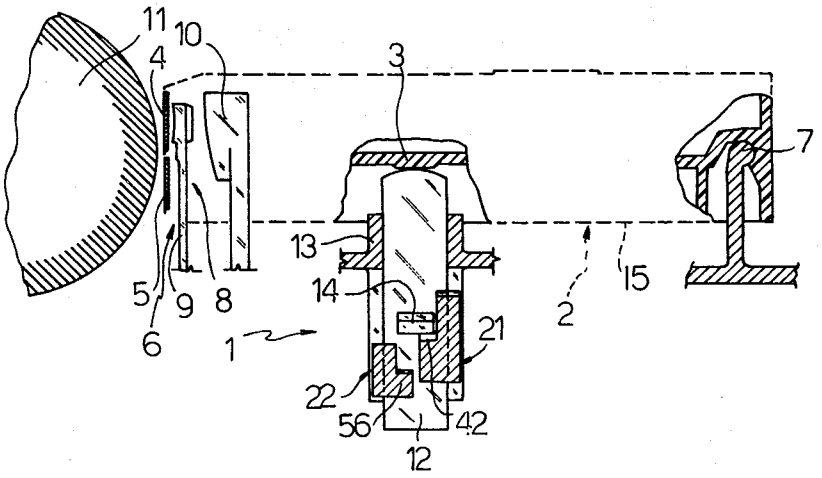
FIG. 2 is a section, on a reduced scale with respect to FIG. 1, taken on the line II—II of FIG. 1.
Figure 3:
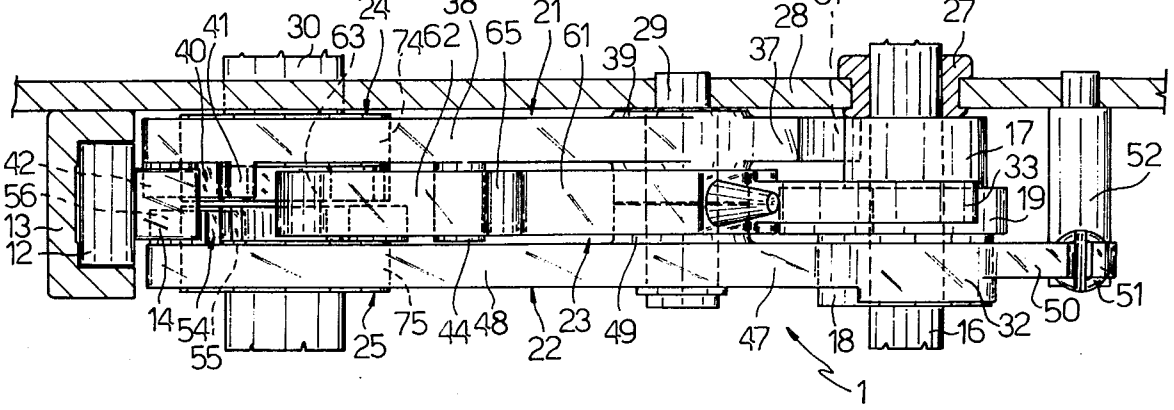
FIG. 3 is a partly sectioned view from above of the mechanism of FIG. 1 with various parts removed for clarity.

With particular reference to FIGS 1, 2 and 3 there is shown a mechanism, generally indicated by the numeral 1, operable to control the positioning of a typewriter ribbon cartridge 2 (FIG. 2) and formed according to the principles of the present invention. As can be seen in FIG. 2, the cartridge 2 is of the type having a frame 3 which supports a ribbon 4 and a ribbon 5 on different planes; conveniently, the ribbon 4 is a typewriter ribbon and the ribbon 5 is a correction ribbon. As is clearly visible in FIG. 2 the frame 3 of the cartridge 2 is rotatably mounted about a pivot 7 which engages the cartridge 2 at the end thereof opposite the end at which the ribbons 4 and 5 are exposed. At this latter end the cartridge 2 has a slot 6 in its underside 15 through which extends, into the interior of the cartridge 2 itself, the end of a typewriting member 8, which in this specific case is constituted by a "petal" 9 of a typewriting unit usually called a "daisy wheel" and which is not illustrated in full. In FIG. 2 there is likewise indicated a print hammer 10 operable to strike the end of the petal 9 on which a predetermined character to be typed is formed, and to press this end against a roller 11. In this way the characteristics of the character carried by the petal 9 are impressed utilizing the material of the typewriter ribbon 4 as the writing material. Still with reference to FIG. 2, the frame 3 of the cartridge 2 is supported at a position intermediate between the pivot 7 and the end at which the ribbons 4 and 5 are exposed by means of a piston 12 which is vertically slidable with respect to a guide 13. The piston 12 has a substantially parallelepiped form with a rounded end and has, in particular, a transverse tongue 14 in an intermediate position extending radially outwardly and constituting a coupling tooth for control elements of the mechanism 1 which are described below. The cartridge 2 therefore rests on the rounded end of the piston 12 and, under its own weight, follows the longitudinal displacements in the vertical direction of the piston 12 by rotating about the pivot 7.

With particular reference to FIGS. 1 and 3, the mechanism 1 includes a drive shaft 16 on which are keyed three cams 17, 18, 19 respectively; first and second rocker levers 21, 22; a third rocker lever 23 located between the levers 21 and 22; a pair of latching mechanisms 24, 25 and the said piston 12. In more detail, the drive shaft 16 is supported, by means of a bush 27, on a wall 28; the wall 28 also supports a pivot pin 29 about which the rocker levers 21 and 22 are rotatable, and, conveniently a pivot pin 30 about which the latching mechanisms 24 and 25 are rotatable. The shaft 16 rotates about its axis in either the clockwise or counterclockwise direction.

The cams 17, 18 and 19 are mounted as a stack with the cam 19 interposed between the cams 17 and 18 and are able to cooperate with a respective portion 31, 32, 33 of the ends of the rocker levers 21, 22, 23. In particular, the profile of the cams 17 and 18 has a shape which increases and decreases linearly and continuously throughout the 360° arc, whilst the profile of the cam 19 has a discontinuity which defines a tooth 34 which can engage a corresponding tooth 35 on the end portion 33 of the lever 23.

The lever 21 has a first arm 37 which carries the end portion 31 and a second arm 38 connected to the arm 37 by means of a hub 39 (FIG. 3) rotatable about the pivot pin 29. The arm 38 of the lever 21 carries at its end an L-shaped projection 40 substantially consituted by a vertical wall 41 and a horizontal wall 42; this latter wall 42 has on its upwardly facing side (see FIG. 1) a semicylindrical surface on which rests a part of the transverse tab 14 of the piston 12. The L-shaped projection 40 extends laterally from the arm 38 towards the lever 22 and has, in the connection region between its walls 41 and 42, an inclined surface 43 (FIG. 1). The lever 21 has, moreover, in a position intermediate between the hub 39 and the L-shaped projection 40, a further, substantially parallelepiped projection 44 with rounded edges and which also extends, like the projection 40, towards the lever 22.

Similarly to what is described with reference to the lever 21, the rocker lever 22 has a first arm 47 on which the end portion 32 is formed, and a second arm 48 joined to the arm 47 by a hub 49 (see FIGS. 1 and 3). As well as the end portion 32, there extends from the lever 22 a projection 50 connected, by means of a helical spring 51, to a peg 52 supported by the wall 28. The arm 48 of the lever 22 also carries at its end an L-shaped projection 54 extending transversely with respect to the arm 48 itself and on the side facing the lever 21. More particularly, the projection 54 has a vertical wall 55 connected to a horizontal wall 56; this latter wall 56 has a rounded upper surface and is able to support a part of the transverse tab 14 of the piston 12. The upper surface 57 of the vertical wall 55 is inclined obliquely with respect to the vertical wall 55 itself.

The lever 23 is, as already mentioned, located in an intermediate position between the rocker levers 21 and 22 and has, in particular, a first arm 61 which carries at its end the end portion 33, and a second arm 62 carrying at its end a tooth 63. In the junction region between the arms 61 and 62 two transverse teeth 65, 64 extend radially upwardly and downwardly respectively. The tooth 64 faces downwardly and is able to cooperate with the transverse projection 44 extending from the lever 21, whilst the projection 65 can cooperate with a fixed wall 66 which serves as an abutment stop against upward displacement of the lever 23. Lever 23 receives a predominantly longitudinal thrust with a transverse downward component from a coil spring 68 the opposite ends of which are respectively maintained in position from inside by a peg 69 which projecs from the arm 61 of the lever 23 and by a peg 70 carried by a fixed support wall 71 connected, for example, in a manner not illustrated, to the wall 66. The action exercised by the spring 68 is such that the transverse tooth 64 of the lever 23 is maintained constantly pressed against the projection 44 of the lever 21; the projection 44 thus behaves as a fulcrum for the lever 23 which, as well as rotating about the projection 44 itself, is also constrained to follow the pivoting movements of the lever 21 about the pivot pin 29.

Each of the latching mechanisms 24, 25 has a respective hub 74, 75 rotatable as already mentioned about the pivot pin 30 (see FIG. 3).

As can be seen better from FIGS. 4 and 5, from each hub 74, 75 extends a first arm 76, 77 and a second arm 78, 79, respectively. Each first arm 76, 77 is able to cooperate with a common stop pin 80, whilst each second arm 78, 79 is maintained under resilient tension with respect to the pin 80 by means of a respective spring 82, 83. From each hub 74, 75 projects a fork element 84, 85 which extends substantially into the region lying between the ends of the levers 21 and 22 carrying the respective projections 40, 54. In more detail, the fork element 84 has on one side an arm 86 the end of which is suitable for engagement by the tooth 63 of the lever 23 whilst the other side has an arm 87 which is cut off at the root in such a way as to define an oblique surface 88 which can cooperate with the inclined surface 43 of the projection 40 of the lever 21 in such a way as to support lever 21 in a predetermined position.

With reference to FIG. 4, the fork element 85 has a first arm 90 extending vertically for a distance less than the corresponding arm 86 of the fork element 84 described above. Moreover, the fork element 85 has a second arm 91 which is tapered towards its end, having a tooth 92 on the outer surface in a position facing the hub 75, an inclined surface 93 of which tooth 92 can cooperate with the surface 57 of the projection 54 carried by lever 22 (see also FIG. 1).

As described above, the latching mechanisms 24 and 25 serve as positioning elements for the respective levers 21 and 22; in particular, the latching mechanism 24 supports the lever 21 which otherwise would rotate in an anti-clockwise sense (FIG. 5) thrust by the weight of the piston 12 and the cartridge 2 (FIG. 2); the latching mechanism 25, however, holds fixed the lever 22 which is urged to rotate in a clockwise sense by the spring 51.

The operation of the mechanism 1 is now described by making particular reference to FIGS. 4 to 10 and taking account of the fact that this mechanism 1 serves substantially to control the positioning of the cartridge 2 (FIG. 2) in three different positions in such a way that in front of the petal 9 of the typing element 8 there is respectively presented the ribbon 4, the ribbon 5 or neither of the ribbons 4 or 5. In the particular case now described the ribbons 4 and 5 are in the following called the "typewriter ribbon" and "correction ribbon" respectively. Thus, as will be seen from the following, the piston 12 is able to assume, with respect to the guide 13, three distinct longitudinally separated working positions in such a way as to support the frame 3 of the cartridge 2 in three different positions.

With particular reference to FIGS. 4 and 5, the piston 12 is illustrated in an intermediate position corresponding (in FIG. 2) to the positioning of the typewriter ribbon 4 in front of the end of the petal 9. The piston 12 is supported in this position by the L-shaped projection 40 of the lever 21: in fact, the tongue 14, which extends transversely from the piston 12, rests on the horizontal wall 42 of projection 40. The lever 21 is moreover held in position by the latch mechanism 24 (see FIG. 5), the arm 87 of the fork element 84 has the inclined surface 88 which cooperates with the inclined surface 43 of the shaped projection 40 in such a way as to prevent the anti-clockwise rotation of the lever 21 and therefore the consequent fall under gravity of the piston 12 and lowering of the frame 3 of the cartridge 2. The latching mechanism 24 is held in position by the spring 82, which in particular holds the arm 76 of the latching mechanism 24 against the stop pin 80.

FIG. 4 illustrates in detail the position assumed by the lever 22 when it is desired to position the typewriter ribbon 4 in front of the petal 9. In particular, the lever 22 is totally rotated in the anti-clockwise sense against the action exercised by the spring 51 and is held in position by the latching mechanism 25; in fact, the tooth 92 of the second arm 91 of the latching mechanism 25 has the inclined surface 93 which rests on the inclined surface 57 of the shaped projection 54 of the lever 22. The latching mechanism 25 is in turn correctly maintained in position by means of the spring 83. During typewriting the layer 23 is not involved and therefore rests on the parallelepiped projection 44 carried by the lever 21 and is conveniently urged by the spring 68 against the surface of the cam 19.

Figure 8:
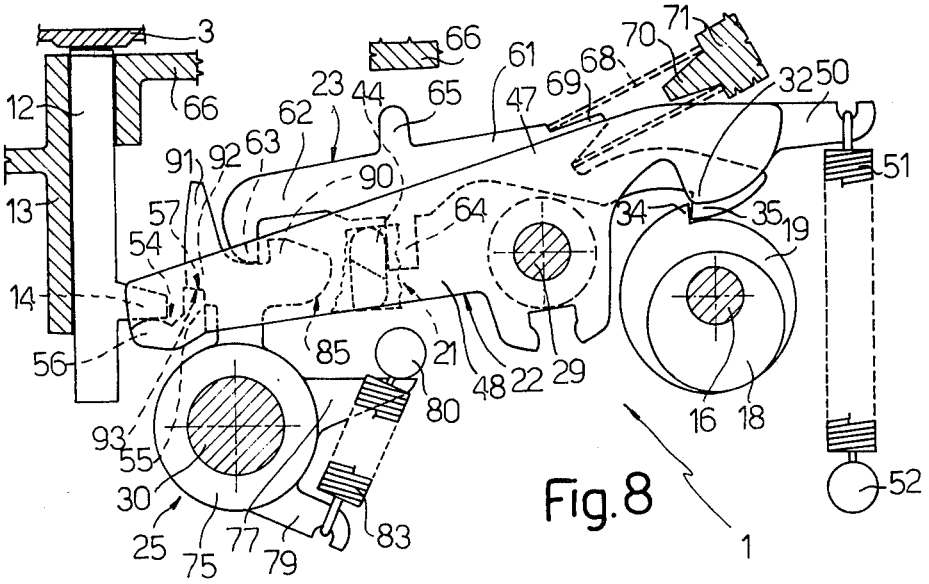

With reference to FIGS. 6, 7 and 8 there is illustrated a complete cycle which is called the "visualization cycle" during which the piston 12 remains lowered and in this way permits the user to see the line of typing on which the typing member 8 acts since the frame 3 of the cartridge 2 is lowered and therefore both the ribbons 4 and 5 are in a lowered position. The control of the visualization cycle is effected by means of the shaft 16 and in two stages; in a first stage the shaft 16 rotates clockwise by an angle of predetermined magnitude, and in a second stage the same shaft 16 turns in an anticlockwise sense through an angle equal to that mentioned above. The displacements caused, by means of the cams 17, 18, 19 on the respective levers 21, 22, 23 and the respective positions assumed by such levers 21–23 are illustrated in FIG. 6 as far as the rotation in the clockwise sense (first stage) is concerned and in FIG. 7 and 8 as far as rotation in the anti-clockwise sense (second stage) is concerned. In particular, with reference to FIG. 6, the clockwise rotation of the shaft 16 causes engagement of the tooth 35 of the lever 23 by the tooth 34 of the cam 19 and therefore the engagement, by the tooth 63 of the lever 23, of the end of the arm 86 of the latching mechanism 24, thereby causing latching mechanism 24 to rotate in the clockwise sense against the resilient action exercised by the spring 82. As is clearly visible in FIGS. 5 and 6, the tooth 63 of the lever 23 moves the end of the arm 86 without simultaneoulsy involving the first arm 90 of the latching mechanism 25. In fact, the lever 23 is initially held raised by the parallelepiped projection 44 carried by the lever 21 and the tooth 63 is therefore not able to engage the first arm 90 mentioned above, this latter arm 90 extending to a height less than the arm 86. Subsequently, as is seen in FIG. 6, the tooth 63, still continuing to carry with it the arm 86 under the action of the cam 19, rests and slides on the upper surface of the arm 90 of the latching mechanism 25. During the course of the subsequent anti-clockwise rotation of the shaft 16 (second stage) the lever 23, urged by the spring 68, is displaced from the right towards the left (FIG. 7) and since it is no longer held raised by the transverse projection 44 of the lever 21, it rests with its tooth 63 in the connection region between the arms 90 and 91 of the form element 85. The transverse projection 44 of the lever 21 now prevents any longitudinal displacements from right to left of the lever 23. In FIG. 7 it can be seen that the arm 87 of the latching mechanism 24 abuts against the surface of the vertical wall 41 of the L-shaped projection 40 of the lever 21 which is now rotated in an anti-clockwise sense and assumes a rest position established by the cam 17 with which the end portion 31 of the lever 21 itself cooperates. In FIG. 8 there is illustrated the situation which arises at the end of the visualization cycle with particular reference to the lever 22, which is now in the condition to be freed from engagement with its latching mechanism 25. The configuration of the levers 21 and 22 respectively illustrated in FIGS. 7 and 8 is stable and is attained after a predetermined time starting from the moment when the last typing operation of the typewriter in question occurs. In this way the cartridge 2, at each pause in the typing by the user, would automatically be displaced downwardly by means of the mechanism 1 for the purpose of allowing the user to see the last line of typescript.

A further cycle with forward and reverse rotation of the shaft 16 through a predetermined angle (see FIGS. 9 and 10) now also determines the release of the lever 22 so that the lever 23 is drawn into clockwise rotation by the spring 51 and urges the piston 12 upwardly by means of its projection 54 by making the piston 12 follow a path such that, with reference to FIG. 2, the correction ribbon 5 is located in front of the character carried at the end of the petal 9. In more detail, the operation described above takes place in two consecutive phases, during the first of which a clockwise rotation of the shaft 16 takes place (FIG. 9) and during the second of which an anti-clockwise rotation of the shaft 16 takes place (FIG. 10).

Figure 9:
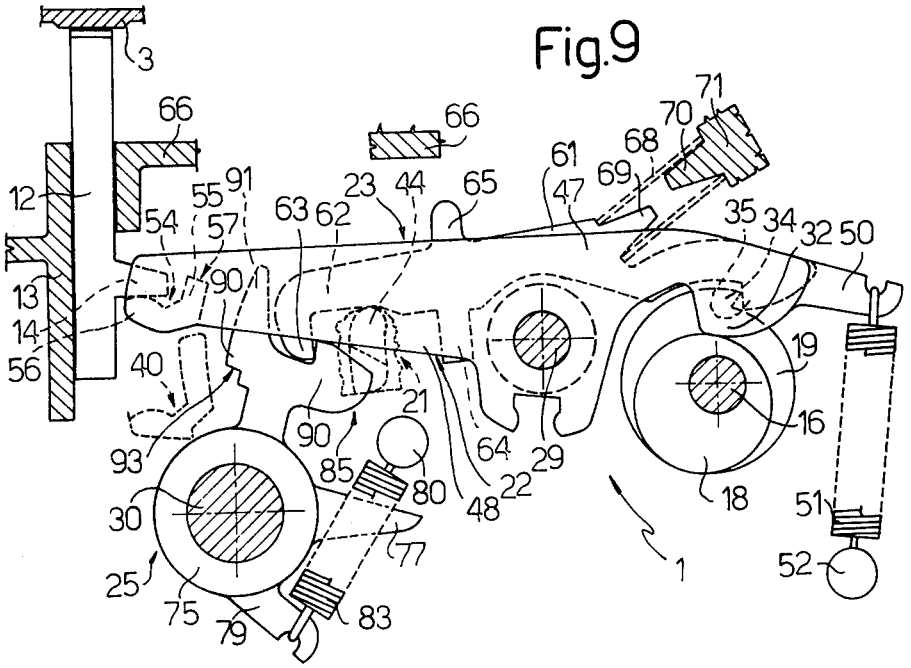
Figure 10:
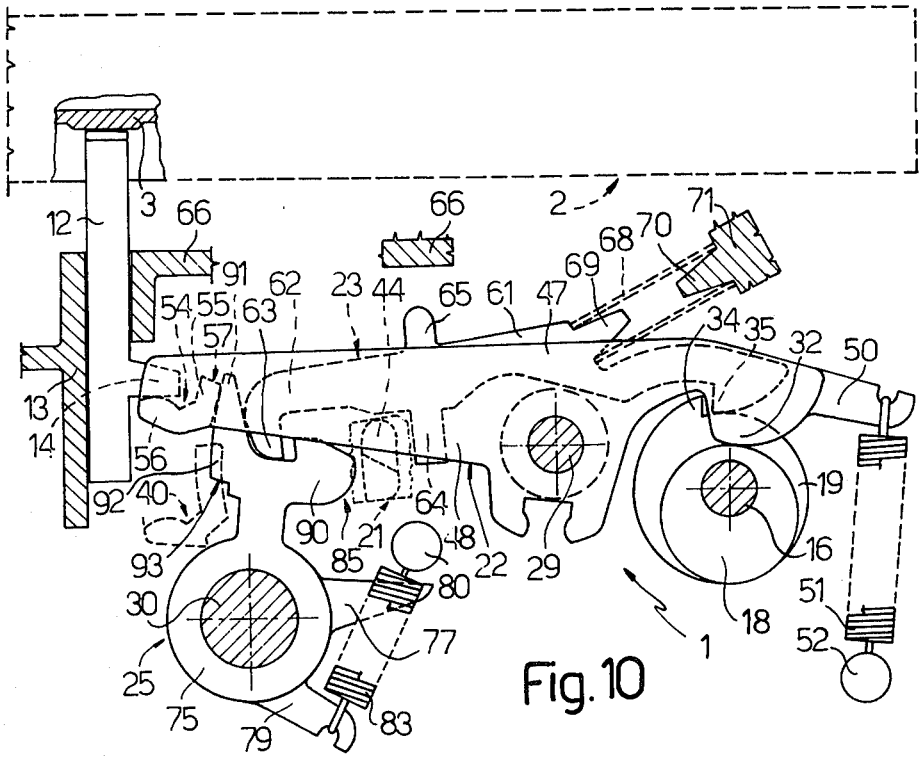

With reference to FIG. 9, the clockwise rotation of the shaft 16 causes the lever 23 to be displaced by the tooth 34 of the cam 19. The lever 23 is displaced in a substantially longitudinal sense against the resilient action exercised by the spring 68 and draws with it, by means of its tooth 63, the arm 90 of the latching mechanism 25 carrying the latching mechanism 25 itself into rotation about the pivot pin 30. Consequently, the tooth 92 of the fork 85 is released from engagement with the vertical wall 55 of the projection 54 and permits the lever 22 to rotate about the pivot pin 29 under the resilient action exercised by the spring 51. This rotation takes place in a clockwise sense and ends when the end portion 32 of the lever 22 abuts on the respective cam 18. During the subsequent anti-clockwise rotation of the shaft 16 the configuration of levers 21–23 illustrated in FIG. 10 occurs, according to which both the levers 21 and 22 are disengaged from their respective latching mechanisms 24 and 25, whilst the piston 12 still maintains the frame 3 of the cartridge 2 raised.

The resetting of the levers 21 and 22 is controlled by an anti-clockwise rotation of substantially a whole revolution of the shaft 16. In fact, during the course of such rotation the cams 17 and 18 act on the respective levers 21 and 22 carrying each of these back to the initial position illustrated in FIG. 1; at the same time the cam 19 does not product any effect on the associated lever 23 since the tooth 35 of lever 23 can only be engaged when the shaft 16 rotates clockwise.

From an examination of the characteristics of the mechanism 1 formed according to the principles of the present invention it will be clear that it can achieve the above-specified objects.

Such mechanism 1 in fact allows three different and stable positions of the cartridge 2 to be obtained by acting simply on the shaft 16, which rotates clockwise or anti-clockwise through an angle of rotation of predetermined value. The levers 21–23, latching mechanisms 24, 25, and cams 17–19 described above, as well as the piston 12 are conveniently made by means of a moulding operation on plastic material so that the cost of the mechanism 1 as a whole is well contained. For the same reason the weight of the mechanism 1 can likewise be contained, with undoubted advantages from the point of view of the overall weight of the typewriter in question.

Finally, it is clear that the mechanism 1 can be modified and varied without by this departing from the scope of the present ivention.

I claim:

1. A typewriter having a typewriting member, having a ribbon cartridge of the type comprising a frame which carries a first and a second ribbon on different planes, and having a mechanism for controlling the positioning of said cartridge with respect to said typewriting member, wherein said mechanism comprises:

(a) a drive shaft capable of rotation about an axis;

(b) a support member which contacts the frame of said cartridge for providing support;

(c) conversion means which convert the rotations of said drive shaft about said axis of rotation into displacements of said support member along a longitudinal axis in such a way as to make said cartridge assume a first, a second, or a third stable position, said first ribbon being located in front of said typewriting member when said cartridge is in said first position, said second ribbon being located in front of said typewriting member when said cartridge is in said second position, and neither said first ribbon nor said second ribbon being located in front of said typewriting member when said cartridge is in said third position, said conversion means comprising:

(i) a first, a second, and a third cam, each of said cams being mounted on said drive shaft for rotation therewith;

(ii) a first and a second rocker lever, each of said rocker levers having a first arm which cooperates with said first and said second cam, respectively, and having a second arm which is operable to control the displacement of said support member along said longitudinal axis;

(iii) a stop pin rigidly fixed relative to said axis of rotation of said drive shaft;

(iv) a firs and a second resilient biasing means connected to said stop pin;

(v) a first and a second latching mechanism, said first latching mechanism cooperating with said first rocker lever against the action of said first biasing means and said second latching mechanism cooperating with said second rocker lever against the action of said second biasing means in such a way that each of said first and said second rocker levers can assume a first or a second working position, said first and said second working positions of said first and said second rocker levers being combined in such a way that said support element assumes a first, a second, or a third stable position corresponding to said first, said second, and said third stable positions of said cartridge; and (vi) a third rocker lever having a first arm which cooperates with said third cam and a second arm operable to control said first and said second latching mechanisms against the action of said first and said second biasing means, respectively.

2. A typewriter according to claim 1, wherein said third rocker lever is mounted interposed between said first and second rocker levers.

3. A typewriter according to claim 1, further comprising a first pivot pin, wherein said first and said second rocker levers are rotatably mounted on said first pivot pin, said first rocker lever comprises a transverse projection extending therefrom, and said third rocker lever rests in an intermediate position on said transverse projection.

4. A typewriter according to claim 3, further comprising a first support peg rigidly fixed relative to said axis of rotation of said drive shaft, and a third biasing means connected at one end to said first support peg and at the other end to said third rocker lever, wherein said third biasing means transmits a thrust to said third rocker lever in a direction which is inclined with respect to the axis of said third rocker lever in such a way as to hold a transverse tooth of said third rocker lever in contact with said transverse projection and to hold an end portion of said first arm of said third rocker lever in contact with said third cam.

5. A typewriter according to claim 4, further comprising a second pivot pin having an axis of symmetry wherein each of said first and said second latching mechanisms is rotatably mounted on said second pivot pin, said third rocker lever has a first end tooth located at the end of said second arm of said third rocker lever, and each of said first and said second latching mecanisms comprises a first tooth which can be hooked by said first end tooth of said third rocker lever.

6. A typewriter according to claim 5, wherein the distance of the tip of said first tooth of said first latching mechanism from the axis of symmetry of said second pivot pin is greater than the distance of the tip of said first tooth of said second latching mechanism from said axis of symmetry of said second pivot pin.

7. A typewriter according to claim 5 wherein each of said first and said second latching mechanisms further comprises a first and a second radial arm, said first radial arm of said first and said second latching mechanism being connected to said first and said second biasing means, respectively, and said second radial arm of said first and said second latching mechanisms cooperating with said stop pin to prevent rotations of said first and said second latching mechanisms, respectively, beyond a predetermined angle.

8. A typewriter according to claim 5, wherein each of said first and said second latching mechanisms further comprises a second tooth, said second tooth of said first and said second latching mechanisms being capable of contacting said second arm of said first and said second rocker lever, respectively, thereby locking said first and said second rocker lever, respectively, in a first predetermined angular position.

9. A typewriter according to claim 8, wherein said first and second teeth of each of said first and second latching mechanisms define a respective fork element.

10. A typewriter according to claim 8, wherein said second tooth of said first latching mechanism supports said first rocker lever in said first predetermined angular position except if said first latching mechanism is displaced by said first end tooth of said third rocker lever, thereby removing the support provided by said second tooth of said first latching mechanism, so that said first rocker lever rotates about said first pivot pin until said first rocker lever reaches a second predetermined angular position.

11. A typewriter according to claim 8, further comprising a second support peg rigidly fixed relative to said axis of rotation of said drive shaft, and a fourth biasing means connected at one end to said second support peg and at the other end to said first arm of said second rocker lever, wherein said second tooth of said second latching mechanism holds said second rocker lever locked in said first predetermined angular position against the resilient action exerted by said fourth biasing means except if said second latching mechanism is displaced by said first end tooth of said third rocker lever, thereby removing the locking contact provided by said second tooth of said second latching mechanism, so that said second rocker lever rotates about said first pivot pin until said second rocker lever reaches a second predetermined angular position.

12. A typewriter according to claim 1, wherein each of said first and said second rocker levers has a lateral projection, each of said lateral projections being able to engage said support member.

13. A typewriter according to claim 12, wherein said support member has a tongue extending radially therefrom, said lateral projections are mounted on confronting lateral surfaces of said first and said second rocker levers, and said support member engages said lateral projections by means of said tongue.

14. A typewriter according to claim 1, further comprising a guide, wherein said support member consists of a piston slidably mounted in said guide.

* * * * *